US009293290B2

(12) United States Patent
Hirasawa et al.

(10) Patent No.: US 9,293,290 B2
(45) Date of Patent: Mar. 22, 2016

(54) SPARE-FUSE HOLDING STRUCTURE

(71) Applicant: YAZAKI CORPORATION, Tokyo (JP)

(72) Inventors: Hitoshi Hirasawa, Shizuoka (JP); Yoshihito Imaizumi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/305,700

(22) Filed: Jun. 16, 2014

(65) Prior Publication Data

US 2014/0377998 A1 Dec. 25, 2014

(30) Foreign Application Priority Data

Jun. 25, 2013 (JP) ..... 2013-132390

(51) Int. Cl.
*H01R 13/68* (2011.01)
*H01H 85/20* (2006.01)

(52) U.S. Cl.
CPC ..... *H01H 85/2045* (2013.01); *H01H 85/2035* (2013.01); *H01H 85/205* (2013.01); *H01H 2085/208* (2013.01)

(58) Field of Classification Search
CPC ..... H01R 13/68
USPC ..... 439/620.27
See application file for complete search history.

(56) References Cited

U.S. PATENT DOCUMENTS

| | | | | |
|---|---|---|---|---|
| 5,145,414 | A | 9/1992 | Oikawa | |
| 5,662,496 | A * | 9/1997 | Kanamori | 439/620.27 |
| 7,264,511 | B2 * | 9/2007 | Asao | 439/620.27 |
| 2007/0015382 | A1 | 1/2007 | Asao | |

FOREIGN PATENT DOCUMENTS

| | | | |
|---|---|---|---|
| CN | 202063092 | U | 12/2011 |
| JP | 3841103 | B1 | 11/2006 |
| JP | 2012-213288 | A | 11/2012 |

OTHER PUBLICATIONS

Chinese Office Action for the related Chinese Patent Application No. 201410291043.X dated Dec. 31, 2015.

* cited by examiner

*Primary Examiner* — Phuong Dinh
(74) *Attorney, Agent, or Firm* — Kenealy Vaidya LLP

(57) ABSTRACT

A spare-fuse holding structure holds a spare fuse including a pair of terminals exposed on both sides of a fuse resin main body serving as a resin main part of the spare fuse in a resin housing chamber. The spare-fuse holding structure includes a resin guide portion configured to guide, when the spare fuse is inserted into the resin housing chamber in a manner inclined with respect to the insertion direction, the spare fuse into the resin housing chamber while changing a posture of the spare fuse in the insertion direction by coming into contact with the fuse resin main body to prevent the pair of terminals from coming into contact with resin walls forming the resin housing chamber.

9 Claims, 8 Drawing Sheets

SPARE-FUSE HOLDING STRUCTURE

CROSS-REFERENCE TO RELATED APPLICATIONS

The present application claims priority to and incorporates by reference the entire contents of Japanese Patent Application No. 2013-132390 filed in Japan on Jun. 25, 2013.

BACKGROUND OF THE INVENTIONS

1. Field of the Invention

The present invention relates to a spare-fuse holding structure that holds a spare fuse in a resin housing chamber.

2. Description of the Related Art

Conventional electrical junction boxes on which a number of fuses are integrally counted include a spare-fuse holding structure to hold a spare fuse. Japanese Patent No. 3841103, for example, discloses in electric connection box including a spare-fuse holding structure on the inner side of an upper cover covering an upper opening of the electric connection box.

In the spare-fuse holding structure disclosed in Japanese Patent No. 3841103, a spare fuse is held in a resin housing chamber with terminals of the spare fuse fit into slits.

When the spare fuse is inserted in a manner inclined with respect to the insertion direction into the resin housing chamber in the spare-fuse holding structure disclosed in Japanese Patent No. 3841103, the terminals come into contact with resin walls forming the resin housing chamber while applying excessive stress thereto. This may possibly damage the terminals or the resin housing chamber.

In view of the disadvantage described above, the present invention aims to provide a spare-fuse holding structure capable of preventing a terminal of a spare fuse or a resin housing chamber that houses the spare fuse from being damaged.

SUMMARY OF THE INVENTION

It is an object of the present invention to at least partially solve the problems in the conventional technology.

According to one aspect of the present invention, a spare-fuse holding structure that holds a spare fuse including a pair of terminals exposed on both sides of a fuse resin main body serving as a resin main part of the spare fuse in a resin housing chamber, the spare-fuse holding structure includes a resin guide portion configured to guide, when the spare fuse is inserted into the resin housing chamber in a manner inclined with respect to an insertion direction, the spare fuse into the resin housing chamber while changing a posture of the spare fuse in the insertion direction by coming into contact with the fuse resin main body to prevent the pair of terminals from coming into contact with a resin wall forming the resin housing chamber.

Recording to another aspect of the present invention, the resin guide portion includes an insertion-opening-side guide portion configured to guide the spare fuse to an insertion opening of the resin housing chamber, a guide wall configured to guide, when the spare fuse is thrust into the resin housing chamber in a manner inclined with respect to the insertion direction into the resin housing chamber, the spare fuse into the resin housing chamber while changing the posture of the spare fuse in the insertion direction by causing a lower end of the fuse resin main body to come into contact with the guide wall, and an insertion completion positioning portion configured to position the spare fuse at an insertion completion position in the resin housing chamber by causing a lower surface of the fuse resin main body to abut on the insertion completion positioning portion.

According to still another aspect of the present invention the guide wall includes an inclined surface on an inner surface of an upper end, the inclined surface being inclined to have a decreasing wall thickness toward an upper edge surface.

According to still another aspect of the present invention, the resin housing chamber includes a surrounding wall configured to surround in a rectangular shape, when the fuse resin main body has a substantially rectangular shape in section, a side outer periphery of the spare fuse with longitudinal-direction, walls facing each other and short-direction walls facing each other, the insertion-opening-side guide portion includes protruding guide pieces configured to protrude like a piece from both ends of an upper edge surface of each of the longitudinal-direction walls of the surrounding wall and configured to be elastically deferrable toward outside of the resin housing chamber to receive the spare fuse into the resin housing chamber, and the guide wall serves as a wall portion between both ends to which the protruding guide pieces are provided in each of the longitudinal-direction walls.

According to still another aspect of the present invention, the short-direction walls of the surrounding wall each have a slit that facilitates bending and deforming of the protruding guide pieces together with the longitudinal-direction walls toward the outside.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a spare-fuse holding structure according to the present invention are described below in greater detail with reference to the accompanying drawings.

Figure 1:
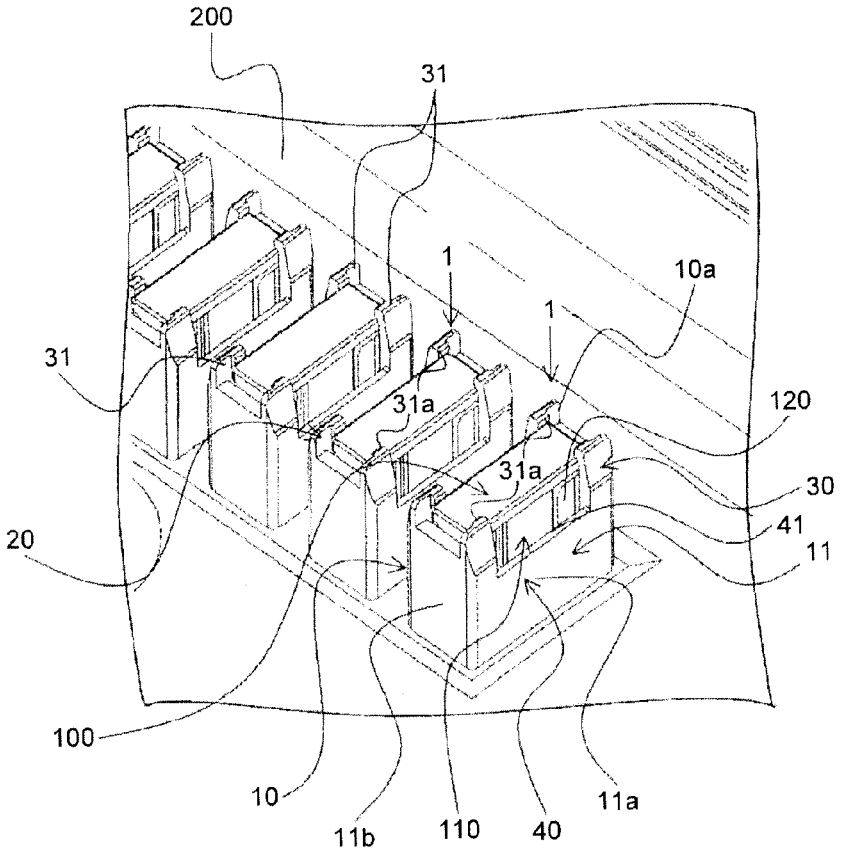
FIG. 1 is a perspective view of a state where a plurality of resin housing chambers including a spare-fuse holding structure according to an embodiment of the present invention are provided on the inner surface of an upper cover and each hold the spare fuse therein.
Figure 2:
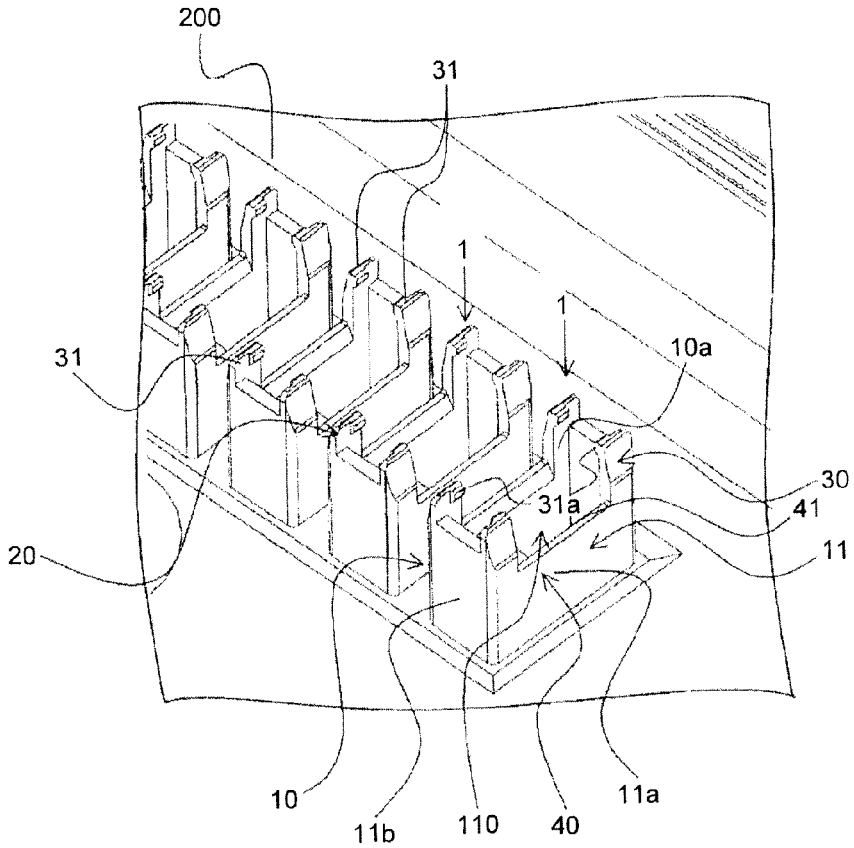
FIG. 2 is a view of a state where the spare fuse is yet to be held in each resin, housing chamber illustrated in FIG. 1.
Figure 3:
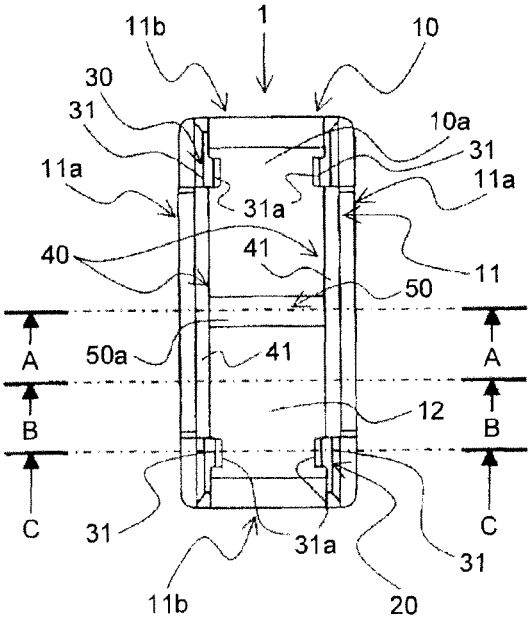
FIG. 3 is a top view of the resin, housing chamber.
Figure 4:
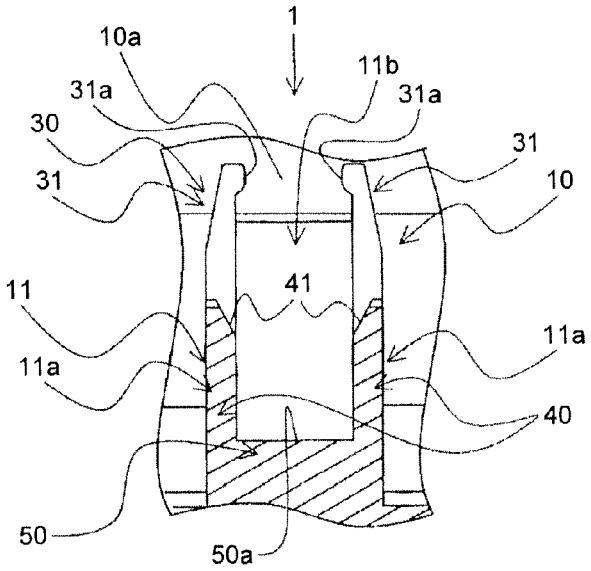
FIG. 4 is a sectional view of the resin housing chamber illustrated in FIG. 3 along line A-A.
Figure 5A:
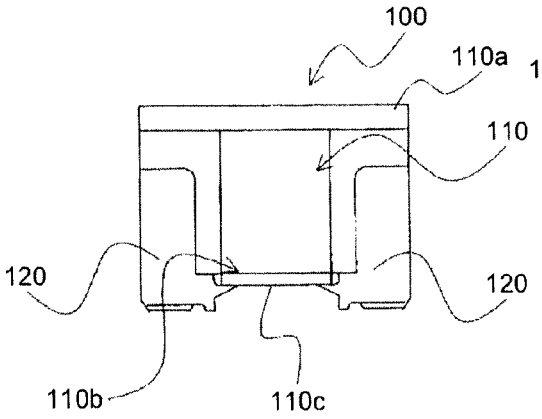
FIG. 5A is a front view of the spare fuse.
Figure 5B:
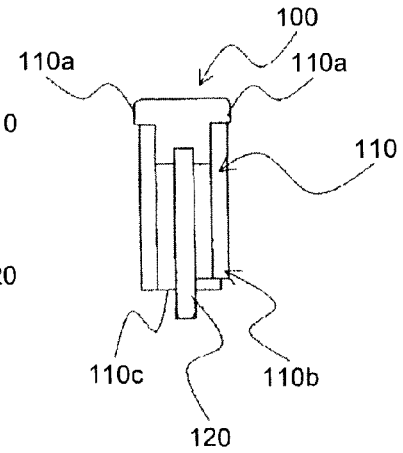
FIG. 5B is a top view of the spare fuse.

FIG. 1 is a perspective view of a state where a plurality of resin housing chambers 10 including a spare-fuse holding structure 1 according to an embodiment of the present invention are provided on the inner surface of an upper cover 200 and each holds a spare fuse 100 therein. FIG. 2 is a view of a state where the spare fuse 100 is yet to be held in each resin housing chamber 10 illustrated in FIG. 1. FIG. 3 is a top view of the resin housing chamber 10. FIG. 4 is a sectional view of the resin housing chamber 10 illustrated in FIG. 3 along line A-A. FIG. 5A is a front view of the spare fuse 100, and FIG. 5B is a top view of the spare fuse 100. In the spare-fuse holding structure 1 according to the embodiment of the present invention, the spare fuse 100 is held in the resin housing chamber 10. The spare-fuse holding structure 1, for example, is provided in plurality in a line on the inner surface of an upper cover covering an upper opening of an electrical junction box (not illustrated) on which a number of fuses are integrally mounted.

The spare fuse 100, which is publicly known, will be described. The spare fuse 100 is what is called a low-height mini fuse. As illustrated in FIGS. 5A and 5B, the spare fuse 100 includes a pair of terminals 120 exposed on both sides of a fuse resin main body 110 serving as a resin main part. The fuse resin main body 110 has a buried fusible portion (not illustrated) serving as wiring for fusing. The fuse resin main body 110 has a substantially rectangular shape in section and includes a flange 110*a* at an upper part thereof. The flange 110*a* is a clamp jig used to pull out the spare fuse 100 held and housed in the resin housing chamber 10 and serves as a projection for what is called a puller. The terminals 120 each have a plate shape and protrude slightly below the fuse resin main body 110.

The spare-fuse holding structure 1 will now be described. As illustrated in FIG. 2, the resin housing chambers 10 each include a surrounding wall 11 and the inner surface of the upper cover 200. The surrounding wall 11 stands on the inner surface of the upper cover 200 such that an insertion opening 10*a* for the spare fuse 100 faces upward. The inner surface of the upper cover 200 serves as a bottom surface 12 of the resin housing chamber 10.

The surrounding wall 11 forms a housing space of a rectangular shape in section corresponding to the shape of the spare fuse 100. The surrounding wall 11 surrounds the side outer periphery of the spars fuse 100 in a rectangular shape with longitudinal-direction walls 11*a* and 11*a* facing each other and short-direction walls 11*b* and 11*b* facing each other.

The spare-fuse holding structure 1 includes a resin guide portion 20. When the spare fuse 100 is inserted into the resin housing chamber 10, the resin guide portion 20 guides the spare fuse 100 into the resin housing chamber 10 by coming into contact with the fuse resin main body 110 to prevent the pair of terminals 120 from coming into contact with the resin walls forming the resin housing chamber 10.

The resin guide portion 20 includes an insertion-opening-side guide portion 30, a guide wall 40, and an insertion completion positioning portion 50. The insertion-opening-side guide portion 30 guides the spare fuse 100 to the insertion opening of the resin housing chamber 10. The guide wall 40 guides the spare fuse 100 into the resin housing chamber 10 by causing a lower end of the fuse resin main body 110 to come into contact with the guide wall 40. The insertion completion positioning portion 50 positions the spare fuse 100 at an insertion completion position in the resin housing chamber 10.

The insertion-opening-side guide portion 30 includes protruding guide pieces 31 protruding like a piece from both ends of an upper edge surface of each of the longitudinal-direction walls 11*a*. The protruding guide pieces 31 are provided such that the tip thereof is elastically deferrable toward the outside of the resin housing chamber 10 to receive the spare fuse 100 into the resin housing chamber 10.

The protruding guide pieces 31 each have a holding protrusion 31*a* protruding from the inner surface of the tip toward the inside of the resin housing chamber 10. When the spare fuse 100 is housed in the resin housing chamber 10, the holding protrusion 31*a* prevents the spare fuse 100 from coming out from the insertion opening of the resin housing chamber 10 and holds the spare fuse 100 in the resin housing chamber 10.

To house the spare fuse 100 in the resin housing chamber 10, the insertion-opening-side guide portion 30 can temporarily hold the spare fuse 100 near the insertion opening 10*a*. More specifically, the spare fuse 100 can remain near the insertion opening 10*a* with the flange 110*a* caught on at least one of the holding protrusions 31*a*.

When the spare fuse 100 is thrust into the resin housing chamber 10 in a manner inclined with respect to the insertion direction into the resin housing chamber 10, the guide wall 40 guides the spare fuse 100 into the resin housing chamber 10 while changing the posture of the spare fuse 100 in the insertion direction by causing a lower end 110*b* of the fuse resin main body 110 to come into contact with the guide wall 40.

The guide wall 40 serves as a wall portion between both ends to which the protruding guide piece 31 is provided in each longitudinal-direction wall 11*a*. The height of the guide wall 40 is adjusted to enable a puller, which is not illustrated, to clamp the spare fuse 100 and to enable the lower end of the fuse resin main body 110 to come into contact with the guide wall 40 when the spare fuse 100 is temporarily held in a manner inclined with respect to the longitudinal-direction wall 11*a* with the insertion-opening-side guide portion 30.

The guide wall 40 includes an inclined surface 41 on the inner surface of the upper end. The inclined surface is inclined such that the wall thickness decreases toward the upper edge surface. With the inclined surface 41, the spare fuse 100 is guided into the resin housing chamber 10 with the lower end of the fuse resin main body 110 smoothly sliding on the inclined surface 41.

The insertion completion positioning portion 50 positions the spare fuse 100 at the insertion completion position in the resin housing chamber 10 by causing a lower surface 110*c* of the fuse resin main body 110 to abut on the insertion completion positioning portion 50. The insertion completion positioning portion 50 is a portion protruding on the bottom surface 12 of the resin housing chamber 10 on which the fuse resin main body 110 of the spare fuse 100 housed in the resin housing chamber 10 abuts. The insertion completion positioning portion 50 includes a protruding end surface 50*a* on which the lower end of the fuse resin main body 110 abuts.

The following describes an operation to guide the spare fuse 100 with the resin guide portion 20 and hold the spare fuse 100 in the resin housing chamber 10 with reference to FIGS. 6A, 6B, 6C, and 6D and FIGS. 7A and 7B. FIGS. 6A, 6B, 6C, and 6D and FIGS. 7A and 7B are views of an operation to guide the spare fuse 100 with the resin guide portion 20 and hold the spare fuse 100 in the resin housing chamber 10. The right figures (FIGS. 6B and 6D and FIG. 7B) are sectional views of the resin housing chamber 10 illustrated in FIG. 3 along line B-B, whereas the left figures (FIGS. 6A and 6C and FIG. 7A) are sectional views of the resin housing chamber 10 illustrated in FIG. 3 along line C-C.

Figure 6A:
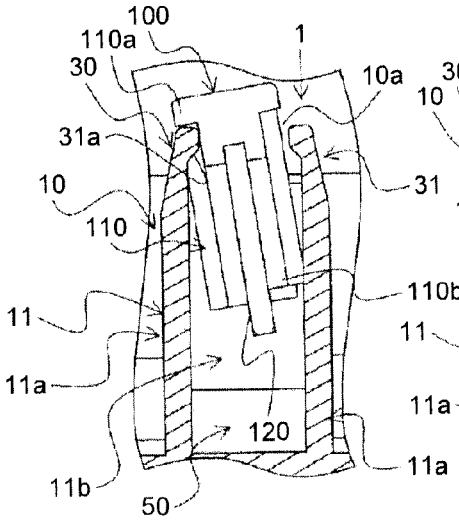
FIGS. 6A, 6B, 6C, and 6D are views of an operation to guide the spare fuse with a resin guide portion and hold the spare fuse in the resin housing chamber.
Figure 6B:
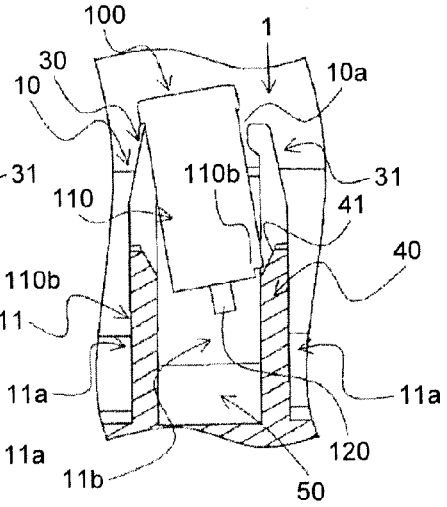

The spare fuse 100 is temporarily held near the insertion opening 10*a* of the resin housing chamber 10 with the insertion-opening-side guide portion 30 (FIGS. 6A and 6B). In this operation, the spare fuse 100 is inserted into the insertion opening 10*a* of the resin housing chamber 10 such that the flange 110*a* of the spare fuse 100 is caught on at least one of the holding protrusion 31*a* with the inner surface of the upper cover 200 facing upward. By temporarily holding the spare fuse 100 in this manner, no relatively large pressure is applied to the spare fuse 100 by as operator. This can prevent the terminals 120 of the spare fuse 100 or the resin housing chamber 10 from being damaged.

Figure 6C:
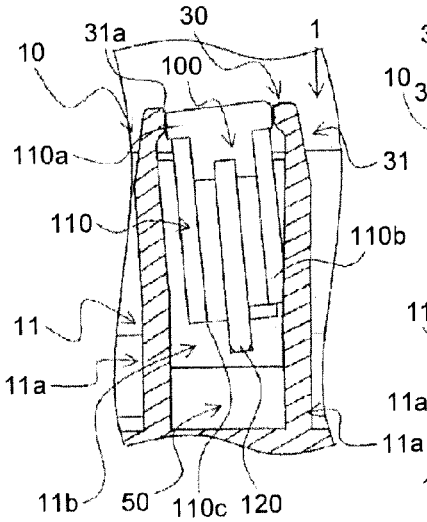
Figure 6D:
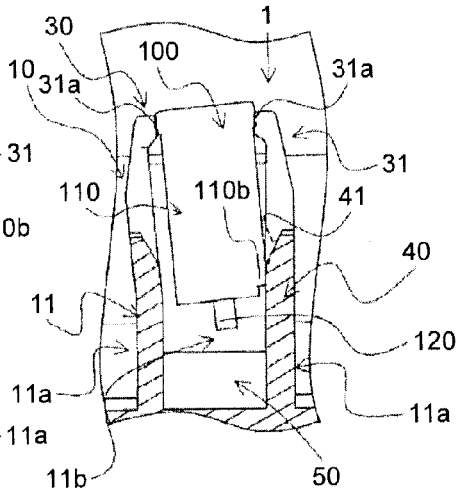

Subsequently, the flange 110*a* elastically bends the protruding guide pieces 31 to enlarge the insertion opening 10*a*, and the spare fuse 100 is further inserted into the resin housing chamber 10 while getting over the holding protrusions 31*a* (FIGS. 6C and 6D). In this operation, a relatively large pressure is applied to the spare fuse 100 by the operator. When the spare fuse 100 is thrust into the resin housing chamber 10 in a manner inclined with respect to the insertion direction into the resin housing chamber 10 with the insertion-opening-side guide portion 30, the lower end 110*b* of the fuse resin main body 110 comes into contact with the guide wall 40 to prevent the pair of terminals 120 of the spare fuse 100 from coming into contact with the resin walls forming the resin housing chamber 10. More specifically, the lower end 110*b* of the fuse resin main body 110 smoothly slides on the inclined surface 41 of she guide wall 40, whereby the spare fuse 100 is guided into the resin housing chamber 10 while changing the posture thereof in the insertion direction into the resin housing chamber 10.

Figure 7A:
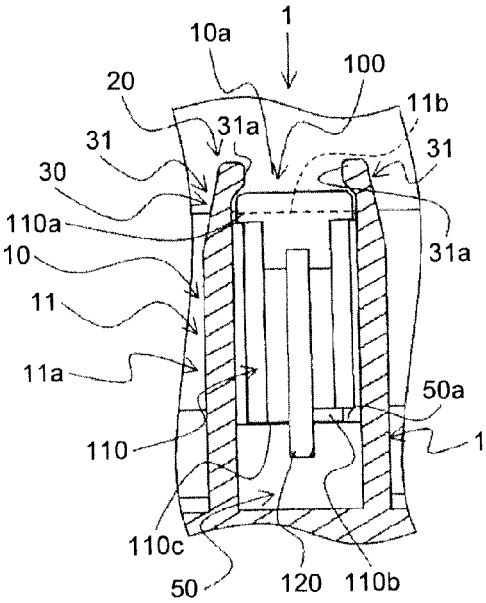
FIGS. 7A and 7B are views of the operation to guide the spare fuse with the resin guide portion and hold the spare fuse in the resin housing chamber.
Figure 7B:
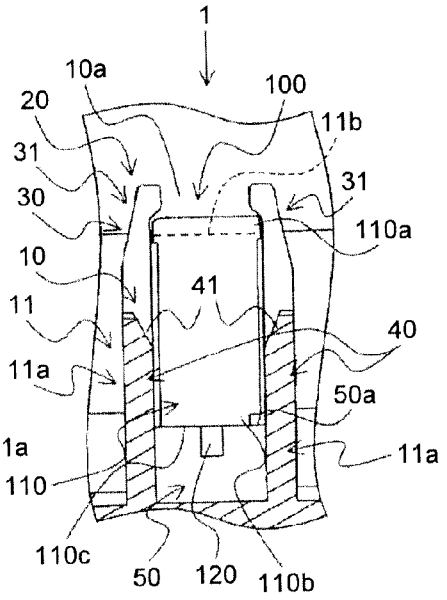

Subsequently, the spare fuse 100 is further inserted into the resin housing chamber 10 until the lower surface 110*c* of the fuse resin main body 110 abuts on the insertion completion positioning portion 50 and thus is held in the resin housing chamber 10 (FIGS. 7A and 7B). When the spare fuse 100 is further inserted into the resin housing chamber 10, the flange 110*a* gets over the holding protrusions 31*a*, and then the protruding guide pieces 31 are elastically restored. Thus, the spare fuse 100 is held with the holding protrusions 31*a* so as not to come out of the resin housing chamber 10.

In the spare-fuse holding structure 1 according to the embodiment of the present invention, when the spare fuse 100 is inserted into the resin housing chamber 10 in a manner inclined with respect to the insertion direction, the spare fuse 100 is guided into the resin housing chamber 10 with the fuse resin main body 110 in contact with the resin guide portion 20 to prevent the pair of terminals 120 from coming into contact with the resin walls forming the resin housing chamber 10. Because the spare fuse 100 and the resin guide portion 20 come into contact with each other at the resin portions, both the spare fuse 100 and the resin guide portion 20 are unlikely to be damaged. In addition, the terminals 120 do not come into contact with any resin wall forming the resin housing chamber 10. This can prevent the terminals 120 of the spare fuse 100 or the resin housing chamber 10 chat houses the spare fuse 100 from being damaged.

In the spare-fuse holding structure 1 according to the embodiment of the present invention, the fuse resin main body 110 comes into contact with the insertion-opening-side guide portion 30, the guide wall 40, and the insertion completion positioning portion 50 from when insertion of the spare fuse 100 into the resin housing chamber 10 is started to when the insertion is completed. This can reliably prevent the pair of terminals 120 of the spare fuse 100 from coming into contact with the resin walls forming the resin housing chamber 10.

In the spare-fuse holding structure 1 according to the embodiment of the present invention, the lower end 110*b* of the fuse resin main body 110 comes into contact with the inclined surface 41 of the guide wall 40. The guide wall 40 can smoothly change the posture of the spare fuse 100 in the insertion direction.

In the spare-fuse holding structure 1 according to the embodiment of the present invention, the protruding guide pieces 31 are provided at both ends of the longitudinal-direction walls 11*a* facing respective longitudinal-direction surfaces of the fuse resin main body 110 clamped by the clamp jig (not illustrated) that clamps the spare fuse 100. This enables adjustment of the height of the guide wall 40 provided between the protruding guide pieces 31 without considering guiding of the spare fuse 100 to the insertion opening of the resin housing chamber 10. In other words, the height of the guide wall 40 can be adjusted so enable the lower end 110*b* of the fuse resin main body 110 to come into contact with the guide wall 40 when the spare fuse 100 is thrust into the resin housing chamber 10 in a manner inclined with respect to the insertion direction into the resin housing chamber 10 and to form a void through which the clamp jig can pass above the wall.

Modification

Figure 8:
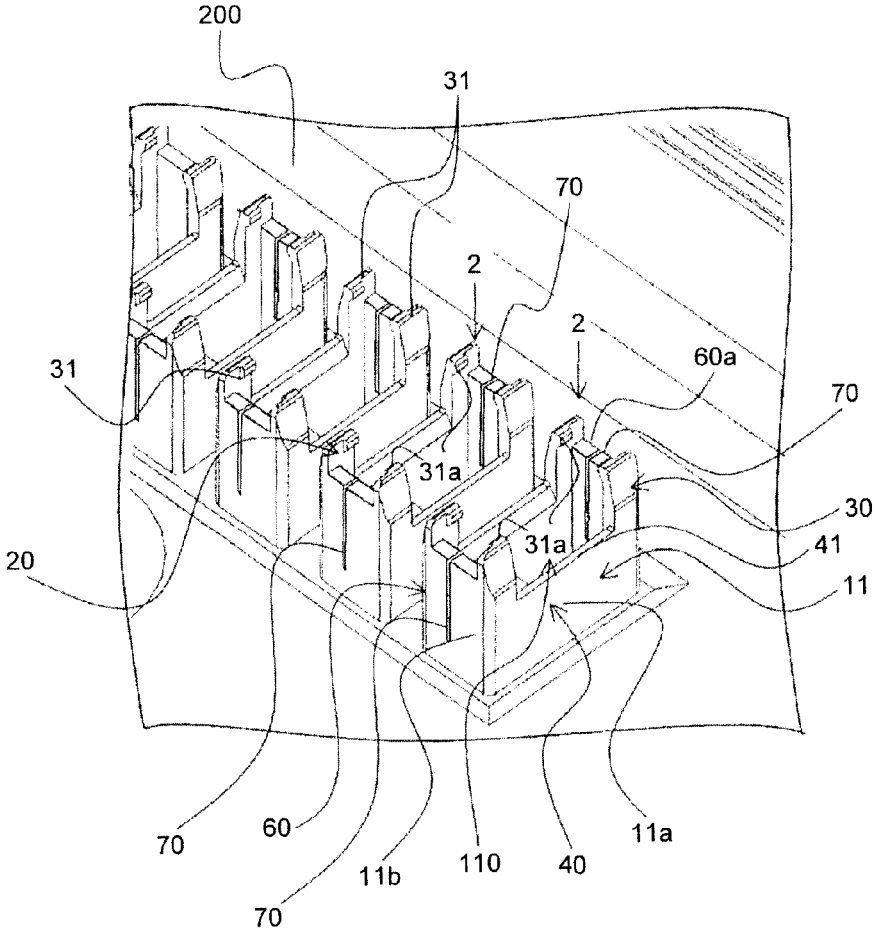
FIG. 8 is a perspective view of a configuration in which a plurality of resin housing chambers including a spare-fuse holding structure according to a modification of the present invention are provided on the inner surface of an upper cover.

The following describes a modification of the spare-fuse holding structure 1 according to the embodiment of the present invention with reference to FIG. 8. FIG. 8 is a perspective view of a configuration in which a plurality of resin housing chambers 60 including a spare-fuse holding structure 2 according to the modification of the present invention are provided on the inner surface of the upper cover 200. The spare-fuse holding structure 2 according to the modification is different from the spare-fuse holding structure 1 according to the embodiment in that slits 70 are formed in the short-direction walls 11*b* facing each other of the resin housing chamber 60. Because the other components are the same as those in the embodiment, components similar to those in the embodiment are denoted by same reference numerals.

The spare-fuse holding structure 2 according to the modification has the slits 70 formed substantially in the center of the respective short-direction walls 11*b*. The slits 70 facilitate bending and deforming of the protruding guide pieces 31 together with the longitudinal-direction walls 11*a* toward the outside of the resin housing chamber 60. This can facilitate enlarging an insertion opening 60*a* to insert the spare fuse 100 into the resin housing chamber 60.

The spare-fuse holding structure 2 according to the modification provides advantageous effects similar to those of the spare-fuse holding structure 1 according to the embodiment. In addition, the slits 70 facilitate bending and deforming of the protruding guide pieces 31 together with the longitudinal-direction walls 11*a* toward the outside of the resin housing chamber 60. This can further facilitate enlarging the insertion opening 60*a* of the resin housing chamber 60 to insert the spare fuse 100 into the resin housing chamber 60, thereby further facilitating the insertion of the spare fuse 100 into the resin housing chamber 10.

Although she explanation has been made of an example in which the spare-fuse holding structures 1 and 2 according to the embodiment of the present invention are provided to an electrical junction box, which is not illustrated, the present invention is not limited thereto. The spare-fuse holding structures 1 and 2 according to the embodiment of the present invention may be provided to other devices including a fuse.

In the spare-fuse holding structure according to one aspect of the present invention, when the spare fuse is inserted into the resin housing chamber in a manner inclined with respect to the insertion direction, the spare fuse is guided into the resin housing chamber with the fuse resin main body in contact with the resin, guide portion to prevent the pair of terminals from coming into contact with the resin walls forming the resin housing chamber. Because the spare fuse and the resin guide portion come into contact with each other at the resin portions, both the spare fuse and the resin guide portion are unlikely to be damaged. In addition, the terminals do not come into contact with any resin wall forming the resin housing chamber. This can prevent the terminals of the spare fuse or the resin housing chamber that houses the spare fuse from being damaged.

In the spare-fuse holding structure according to another aspect of the present invention, the fuse resin main body comes into contact with the insertion-opening-side guide portion, the guide wall, and the insertion completion positioning portion from when insertion of the spare fuse into the resin housing chamber is started to when the insertion is completed. This can reliably prevent the pair of terminals of the spare fuse from coming into contact with the resin walls forming the resin housing-chamber.

In the spare-fuse holding structure according to still another aspect of the present invention, the lower end of the fuse resin main body comes into contact with the inclined surface of the guide wall. The guide wall can smoothly change the posture of the spare fuse in the insertion direction.

In the spare-fuse holding structure according to still another aspect of the present invention, the protruding guide pieces are provided at both ends of the longitudinal-direction walls facing the respective longitudinal-direction surfaces of the fuse resin main body clamped by the clamp jig that clamps the spare fuse. This enables adjustment of the height of the guide wall provided between the protruding guide pieces without considering guiding of the spare fuse to the insertion opening of the resin housing chamber. In other words, the height of the guide wall can be adjusted to enable the lower end of the fuse resin main body to come in so contact with the guide wall when the spare fuse is thrust into the resin housing chamber in a manner inclined with respect to the insertion direction into the resin housing chamber 10 and to form a void through which the clamp jig can pass above the wall.

In the spare-fuse holding structure according to still another aspect of the present invention, the slits facilitate bending and deforming of the protruding guide pieces together with the longitudinal-direction walls toward the outside of the resin housing chamber. This can further facilitate enlarging the insertion opening of the resin housing chamber to insert the spare fuse into the resin housing chamber, thereby further facilitating the insertion of the spare fuse into the resin housing chamber.

Although the invention has been described with respect to specific embodiments for a complete and clear disclosure, the appended claims are not to be thus limited but are to be construed as embodying ail modifications and alternative constructions that may occur to one skilled in the art that fairly fall within the basic teaching herein set forth.

What is claimed is:

1. A spare-fuse holding structure that holds a spare fuse including a pair of terminals exposed on both sides of a fuse resin main body serving as a resin main part of the spare fuse in a resin housing chamber, the spare-fuse holding structure comprising:

a resin guide portion configured to guide, when the spare fuse is inserted into the resin housing chamber in a manner inclined with respect to an insertion direction, the spare fuse into the resin housing chamber while changing a posture of the spare fuse in the insertion direction by coming into contact with the fuse resin main body to prevent the pair of terminals from coming into contact with a resin wall forming the resin housing chamber, wherein the resin housing chamber includes a bottom surface, and the resin guide portion includes a pair of opposed walls, and a portion protruding from the bottom surface of the resin housing chamber and positioned between the pair of opposed walls.

2. The spare-fuse holding structure according to claim 1, wherein each of the opposed walls includes an inclined surface on an inner surface of an upper end, the inclined surface being inclined to have a decreasing wall thickness toward an upper edge surface.

3. The spare-fuse holding structure according to claim 1, wherein the resin housing chamber includes a surrounding wall configured to surround in a rectangular shape, when the fuse resin main body has a substantially rectangular shape in section, a side outer periphery of the spare fuse, the opposed walls and short-direction walls facing each other, the insertion-opening-side guide portion includes protruding guide pieces configured to protrude like a piece from both ends of an upper edge surface of each of the pair of opposed walls of the surrounding wall and configured to be elastically deformable toward outside of the resin housing chamber to receive the spare fuse into the resin housing chamber, and the guide wall serves as a wall portion between both ends to which the protruding guide pieces are provided in each of the opposed walls.

4. The spare-fuse holding structure according to claim 3, wherein the short-direction walls of the surrounding wall each have a slit that facilitates bending and deforming of the protruding guide pieces together with the opposed walls toward the outside.

5. A spare-fuse holding structure that holds a spare fuse including a pair of terminals exposed on both sides of a fuse resin main body serving as a resin main part of the spare fuse in a resin housing chamber, the spare-fuse holding structure comprising:

a resin guide portion configured to guide, when the spare fuse is inserted into the resin housing chamber in a manner inclined with respect to an insertion direction, the spare fuse into the resin housing chamber while changing a posture of the spare fuse in the insertion direction by coming into contact with the fuse resin main body to prevent the pair of terminals from coming into contact with a resin wall forming the resin housing chamber, wherein the resin guide portion includes an insertion-opening-side guide portion configured to guide the spare fuse to an insertion opening of the resin housing chamber, a guide wall configured to guide, when the spare fuse is thrust into the resin housing chamber in a manner inclined with respect to the insertion direction into the resin housing chamber, the spare fuse into the resin housing chamber while changing the posture of the spare fuse in the insertion direction by causing a lower end of the fuse resin main body to come into contact with the guide wall, and an insertion completion positioning portion configured to position the spare fuse at an insertion completion position in the resin housing chamber by causing a lower surface of the fuss resin main body to abut on the insertion completion positioning portion.

6. The spare-fuse holding structure according to claim 5, wherein the guide wall includes an inclined surface on an inner surface of an upper end, the inclined surface being inclined to have a decreasing wall thickness toward an upper edge surface.

7. The spare-fuse holding structure according to claim 5, wherein the resin housing chamber includes a surrounding wall configured to surround in a rectangular shape, when the fuse resin main body has a substantially rectangular shape in section, a side outer periphery of the spare fuse with longitudinal-direction walls facing each other and short-direction walls facing each other, the insertion-opening-side guide portion includes protruding guide pieces configured to protrude like a piece from both ends of an upper edge surface of each of the longitudinal-direction walls of the surrounding wall and configured to be elastically deformable toward outside of the resin housing chamber to receive the spare fuse into the resin housing chamber, and the guide wall serves as a wall portion between both ends to which the protruding guide pieces are provided in each of the longitudinal-direction walls.

8. The spare-fuse holding structure according to claim 7, wherein the short-direction walls of the surrounding wall each have a slit that facilitates bending and deforming of the protruding guide pieces together with the longitudinal-direction walls toward the outside.

9. The spare-fuse holding structure according to claim 6, wherein the resin housing chamber includes a surrounding wall configured to surround in a rectangular shape, when the fuse resin main body has a substantially rectangular shape in section, a side outer periphery of the spare fuse with longitudinal-direction walls facing each other and short-direction walls lacing each other, the insertion-opening-side guide portion includes protruding guide pieces configured to protrude like a piece from both ends of an upper edge surface of each of the longitudinal-direction walls of the surrounding wall and configured to be elastically deformable toward outside of the resin housing chamber to receive the spare fuse into the resin housing chamber, and the guide wall serves as a wall portion between both ends to which the protruding guide pieces are provided in each of the longitudinal-direction walls.

* * * * *